US005569567A

United States Patent [19]

Tavernier et al.

[11] Patent Number: 5,569,567

[45] Date of Patent: Oct. 29, 1996

[54] NEGATIVELY CHARGED TONER POWDER FOR USE IN ELECTROSTATOGRAPHY

[75] Inventors: Serge Tavernier, Lint; Werner Op de Beeck, Keerbergen; Danny Van Wunsel, Nijlen; Michel Vervoort, Antwerpen, all of Belgium

[73] Assignee: Agfa-Gevaert, N.V., Mortsel, Belgium

[21] Appl. No.: 356,216

[22] PCT Filed: Apr. 25, 1994

[86] PCT No.: PCT/EP94/01321

§ 371 Date: Dec. 14, 1994

§ 102(e) Date: Dec. 14, 1994

[87] PCT Pub. No.: WO94/27192

PCT Pub. Date: Nov. 24, 1994

[30] Foreign Application Priority Data

May 11, 1993 [EP] European Pat. Off. ..... 93201351

[51] Int. Cl.[6] ..... G03G 9/097

[52] U.S. Cl. ..... 430/110; 430/109

[58] Field of Search ..... 430/106, 107, 430/109, 110

[56] References Cited

U.S. PATENT DOCUMENTS

| | | | |
|---|---|---|---|
| 5,230,977 | 7/1993 | Ohta | 430/109 |
| 5,258,254 | 11/1993 | Moriya | 430/109 |
| 5,411,833 | 5/1995 | Swidler | 430/109 |

*Primary Examiner*—John Goodrow
*Attorney, Agent, or Firm*—Breiner & Breiner

[57] ABSTRACT

A dry toner powder the toner particles of which are triboelectrically negatively charged and are suited for development of an electrostatic charge pattern, wherein said toner particles contain:

(1) one or more triboelectrically negatively chargeable thermoplastic resins serving as binder having a volume resistivity of at least $10^{13}\Omega$-cm, and (2) at least one substance having a volume resistivity lower than the volume resistivity of said binder, and wherein said substance(s) (2) is (are) capable of lowering the volume resistivity of said binder by a factor of at least 3.3 when present in said binder in a concentration of 5% by weight relative to the weight of said binder, and wherein said toner powder containing particles including a mixture of said ingredients (1) and (2) under triboelectric charging conditions is capable of obtaining an absolute median (q/d) charge/diameter value (x) lower than 10 fC/10 μm but not lower than 1 fC/10 μm, and said toner powder under the same triboelectric charging conditions but free from said substance(s) (2) then has an absolute median q/d value (x) at least 50% higher than when said substance(s) (2) is (are) present, and wherein the distribution of the charge/diameter values of the individual toner particles is characterized by a coefficient of variation $v \leqq 0.33$.

17 Claims, 3 Drawing Sheets

NEGATIVELY CHARGED TONER POWDER FOR USE IN ELECTROSTATOGRAPHY

DESCRIPTION

1. Field of the Invention

The present invention relates to a negatively charged toner powder suited for use in electrostatography in the development of electrostatic charge images.

2. Background of the Invention

It is well known in the art of electrostatography including electrography and electrophotography to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. electrons or ions onto a dielectric substrate.

The obtained latent images are developed, i.e. converted into visible images by selectively depositing thereon light absorbing particles, called toner particles, which usually are triboelectrically charged. Electrostatic latent images may likewise be toner-developed to form a hydrophobic printing pattern on a hydrophilic substrate resulting thereby in a printing plate for lithographic printing.

In toner development of latent electrostatic images two techniques have been applied: "dry" powder and "liquid" dispersion development of which dry powder development is nowadays most frequently used.

In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, April 1972, pp.495–511. The mean diameter of dry toner particles for use in aerosol or powder cloud development is 1 μm, whereas the mean diameter for toner particles useful in cascade or magnetic brush development is about 10 μm [ref. "Principles of Non Impact Printing" by Jerome L. Johnson—Palatino Press Irvine Calif., 92715 U.S.A. (1986), p. 64–85], but may be from 1 to 5 μm for high resolution development (ref. e.g. GB 2 180 948 A and (PCT) WO 91/00548).

Dry-development toners essentially comprise a thermoplastic binder consisting of a thermoplastic resin or mixture of resins including colouring matter, e.g. carbon black or finely dispersed dye pigments. The triboelectric chargeability of the toner particles is defined by said substances and may be modified with a charge controlling agent.

Triboelectric charging of the toner particles proceeds in so-called two-component developer mixtures by means of carrier particles (having a diameter normally at least 10 times larger than the diameter of the toner particles), that for use in magnetic brush development are made of soft magnetic material. In response to the electric field of the latent image, the toner transfers from the carrier beads to the recording material containing an electrostatic charge pattern.

Single component developers operate solely with toner particles in that carrier particles are absent for triboelectric charging. The electrostatic charging of such toner proceeds by frictional contact with the walls of the developer station and/or stirring mechanism operated therein. Single component developers include aerosol, transfer or touchdown and induction toner developers, the latter being conductive toners that are not electrostatically chargeable with a surplus charge. For obtaining magnetic toner the magnetic material is put directly into the toner particles themselves.

One feature of the quality of a printed copy is determined by the optical density of the deposited toner image. Optical density, more particularly the degree how black the developed image is by use of a black toner, is correlated with the mass M of the toner that has been deposited electrostatically onto a unit area A of the latent image, and lateron transferred if necessary to its final receptor element, e.g. plain paper.

Electrostatically charged toner particles will continue to deposit onto the electrostatic charge pattern until some limit of neutralization has been reached. In positive-positive image-reproduction, also called "direct development" the toner deposits onto the areas having a charge sign opposite to the charge sign of the toner particles.

In "reversal development" the toner is deposited in the light-discharged area (ref. e.g. "Electrophotography" by R. M. Schaffert—The Focal Press—London, N.Y., enlarged and revised edition 1975, pp. 50–51). In the light-discharged areas a charge pattern is built up during development by a driving development voltage applied between the development station or biasing electrode inducing charges of opposite charge sign in said light-discharged areas.

An extensive review dealing with the physical phenomena of development is given in: "Electrophotography and Development Physics" by L. B. Schein—Springer Verlag—Springer Series in Electrophysics Volume 14, 1988, p. 94–223.

Electrostatically charged toner particles will continue to deposit onto the electrostatic charge pattern of opposite polarity until the charge pattern has been substantially neutralized. This neutralization would occur when the toner charge per unit area $CT_A$ equals the recording layer charge per unit area $CP_A$, which is determined by the potential V of the charged image area which is represented in the following equation:

$$CP_A = K\epsilon_o\, V/D$$

where K is the dielectric coefficient of the charge-carrying recording layer (e.g. photoconductive layer), $\epsilon_o$ is the dielectric constant of the vacuum and D is the recording layer thickness (ref. the article "Physics of Electrophotography" of Donald M. Burland and Lawrence B. Schein in "Physics Today"/May 1986, p.47–48).

Because the toner charge per unit area equals its charge per unit mass (Q/M) times the developed mass per unit area (M/A), the toner mass per unit area is:

$$M/A = \frac{\epsilon_o V}{D/K} \quad \frac{1}{Q/M}$$

In praxis this result overestimates the developed mass per unit area by about an order of magnitude, but allows to assess the obtainable optical density for a given toner charge/mass ratio.

Last mentioned equation learns that a lower toner charge/mass ratio (Q/M) will allow the deposition of more toner particles per unit area of charged recording layer area. Such will result in higher optical density per unit area for same charge per unit area.

The problem is that toners with low charge/mass ratio normally will have a broad distribution spectrum of charge/mass ratio with regard to the individual toner particles in the developer composition. A broad distribution spectrum of said ratio is characterized by (1) the presence of a relatively large amount of particles that have a charge too low for providing a sufficiently strong coulomb attraction and (2) the presence of wrong charge sign toner particles that have a charge sign opposite to the major part of the bulk of the toner particles. The development with such kind of developer results in an undesirable image-background fog.

Charging of the individual toner particles through triboelectricity (frictional contact between triboelectric partners) is a statistical process which will result in a broad distribution of charge over the number of toner particles in the developer if no proper measures of charge control are taken.

In order to avoid the above defined fog problem and in order to dispose of the capability to produce toner images with high optical density for a given amount of charge per unit area of the recording element it is necessary to solve the problem of manufacturing toner developers having a reasonably low charge/mass (q/m) ratio (Coulomb per gram of toner bulk) and sharp charge/mass distribution (measured as charge/particle diameter distribution) of the individual toner particles of the applied toner bulk.

The requirement of disposing of a toner with low charge/mass ratio (fC/g) and narrow percentage distribution of charge/diameter (q/d) of the toner particles in the toner bulk is the more stringent the more the toner particle size is reduced. The use of small toner particles is in favour of image resolution which together with sufficient optical density and low background fog is largely defining image quality. The relation between q/m and particle size has been discussed by H. Tjujimoto et al. 7th International Congress of Advanced Non-Impact Printing Technologies 1991, p. 406. Since the charge of the toner particles is directly proportional to their surface it is also directly proportional to their diameter (d) squared, whereas the toner particle mass (m) is directly proportional to their diameter cubed. As a consequence thereof q/m is directly proportional to $d^{-1}$, and will increase more rapidly with decreasing particle diameter. Said fact will give rise to lower optical density on using in the development smaller toner particles for same mass of deposited toner. Since for smaller particles the stochastic composition fluctuation will be worse said particles will inherently show an increased tendency to broaden their charge distribution.

Wrong charge sign and no or too low charge will it make impossible to control background fog electrically. A very low particle charge will not only make development more critical but also electrostatic toner image transfer will be very difficult and result in deteriorated images.

According to European patent application (EP-A) 0 488 741 a toner for negative charging comprises a fixing resin, a colorant, a charge-controlling agent for negative charging, and a charge controlling assistant which is a positive charge-controlling substance incompatible with the fixing resin and dispersible therein. The toner is characterized by a sharp distribution of the charge quantity over the toner particles so that highly charged toner particles do not contribute to the development and lowly charged toner particles which are easily scattered are excluded.

The invention described in said EP-A 0 488 741 is based on the finding that if a positive charge-controlling substance incompatible with a fixing resin but dispersible therein is combined as the charge-controlling assistant with a charge-controlling agent for negative charging, instead of a positively chargeable dye compatible with the fixing resin conventionally used, the distribution of the charge quantity can be made conspicuously sharper than in the conventional toner, with the result that formation of highly charged toner particles which do not contribute to development and lowly charged toner particles which are easily scattered is effectively prevented.

As can be learned from said EP-A many of said negative charge-controlling agents are coloured and their colour hue inhibits their use in the preparation of toners having yellow, magenta or cyan colour for use in full colour reproduction.

OBJECTS AND SUMMARY OF THE INVENTION

It is an object of the present invention to provide a dry triboelectrically negatively charged toner useful for developing electrostatic charge patterns with improved optical density and with low background density.

It is another object of the present invention to provide a dry toner essentially consisting of a bulk of negatively charged toner particles having a fairly low charge/mass ratio and particularly sharp charge/mass distribution with regard to the individual toner particles of said bulk.

It is still another object of the present invention to provide a dry triboelectrically negatively charged toner of relatively small particle size that will yield images of improved resolution having high maximum optical density and of which the toner particles do not have a wrong sign (positive charge) that would cause high image backgrounds subsequent to development.

It is a further object of the present invention to provide a method for manufacturing a dry toner wherein the triboelectric chargeability and charge distribution over the individual toner particles can be changed gradually at will.

In accordance with the present invention a dry toner powder is provided the toner particles of which are triboelectrically negatively charged and are suited for development of an electrostatic charge pattern, wherein said toner particles contain:

(1) one or more triboelectrically negatively chargeable thermoplastic resins serving as binder having a volume resistivity of at least $10^{13}\Omega$-cm, and (2) at least one substance having a volume resistivity lower than the volume resistivity of said binder, and wherein said substance(s) (2) is (are) capable of lowering the volume resistivity of said binder by a factor of at least 3.3 when present in said binder in a concentration of 5% by weight relative to the weight of said binder, and wherein said toner powder containing particles including a mixture of said ingredients (1) and (2) under triboelectric charging conditions is capable of obtaining an absolute median (q/d) charge/diameter value (x) lower than 10 fC/10 μm but not lower than 1 fC/10 μm, and said toner powder under the same triboelectric charging conditions but free from said substance(s) (2) then has an absolute median q/d value (x) at least 50% higher than when said substance(s) (2) is (are) present, and wherein the distribution of the charge/diameter values of the individual toner particles is characterized by a coefficient of variation $v \leqq 0.33$.

In order to obtain a desired narrow charge distribution said toner particles need not the presence of a charge-controlling agent for positive charging as is the case in the toners according to said EP-A 0 488 741.

By coefficient of variation (v) is meant here the standard deviation (s) divided by the median value (x).

The spread of charge/diameter values in the toner powder of individual toner particles containing said ingredients (1) and (2) is called standard deviation (s) which for obtaining statistically realistic results is determined at a particle population number of at least 10,000. Said standard deviation divided by said median has according to the present invention to yield an absolute number equal to or smaller than 0.33, when the median q/d value is expressed in fC/10 μm and stems from a curve of a percentage distribution, i.e. % number proportion (in y-ordinate) of a same charge/diameter (q/d) ratio versus q/d in fC/10 μm of toner particles (in x-abscissa), said median being the value of the x-coordinate at which the area under the curve is bisected in equal area parts.

The use of the coefficient of variation (v) is preferred since it is more useful and significant to measure the spread in relative terms than by using the standard deviation (s) alone; it is independent of the units in which the variate is measured, provided that the scales begin at zero [ref. Christopher Chatfield "Statistics for technology" A course in applied statistics—Third ed. (1986) Chapman and Hall Ltd, London, p. 33.].

The present invention provides also a method for manufacturing a dry toner powder bulk in which the toner particles are triboelectrically negatively charged and are suited for development of electrostatic charge images, which method comprises the steps:

(I) blending, e.g. melt blending, (1) (a) thermoplastic resin(s) serving as binder and having negative triboelectric chargeability and a volume resistivity of at least $10^{-}\Omega$-cm, preferably in the absence of a charge-controlling agent for positive charging, with (2) (a) substance(s) capable of lowering the volume resistivity of said resin(s), which substance(s) (2) when present in admixture with said resin(s) in a concentration of 5% relative to the weight of binder are capable of lowering thereof the volume resistivity of said binder by a factor of at least 3.3;

(II) after blending dividing the obtained mixture into small particles, (III) classifying said particles to selectively collect toner particles within a selected diameter range, e.g. in the diameter range of 3 to 12 μm, and (IV) triboelectrically negatively charging said particles hereby obtaining a powder bulk of toner particles in which said substance(s) (2) are present in such an amount that thereby the toner powder bulk has an absolute median (q/d) charge/diameter value (x) lower than 10 fC/10 μm but not lower than 1 fC/10 μm; and wherein the distribution of the charge/diameter values of the individual toner particles is characterized by a coefficient of variation $v \leqq 0.33$.

During said blending one or more colorants are present for preparing a coloured toner, otherwise a substantially colourless toner is formed.

BRIEF DESCRIPTION OF THE DRAWINGS

FIG. 2 also represents toner q/d distribution curves 2 and 3 relating to invention toners showing the shift of narrow q/d distribution curves towards the region of lower net charge by gradually adding increasing amounts of said resistivity decreasing substance (2) (see Example 1 invention toners B and C).

DETAILED DESCRIPTION OF THE INVENTION

In order to know whether or not a particular toner satisfies the properties as defined in the above summary of invention said standard deviation (s) and median q/d of the toner have to be determined. Such may be done by means of a charge spectrograph apparatus operating as schematically shown in FIG. 1.

The apparatus involved is sold by Dr. R. Epping PES-Laboratorium D-8056 Neufahrn, Germany under the name "q-meter". The q-meter is used to measure the distribution of the toner particle charge (q in fC) with respect to a measured toner diameter (d in 10 μm). The measurement result is expressed as percentage particle frequency (in ordinate) of same q/d ratio on q/d ratio expressed as fC/10 μm (in abscissa).

Figure 1:
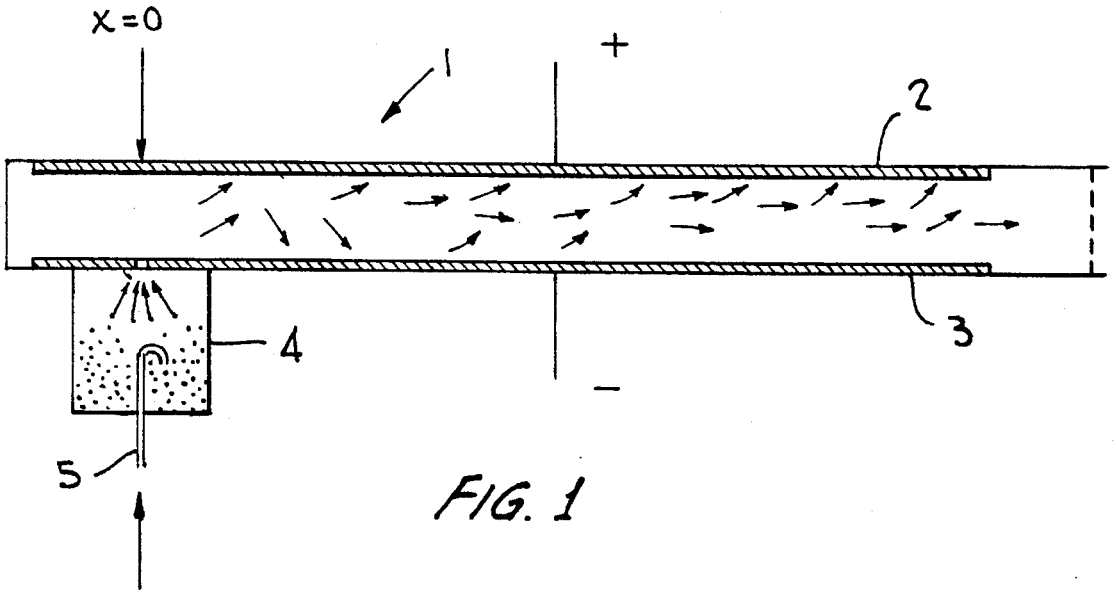
FIG. 1 represents a schematic cross-sectional drawing of an apparatus used in the determination of the above defined standard deviation (s) and median q/d of a toner.

Referring to said FIG. 1 the measurement is based on the different electrostatic deflection according to their q/d ratio of triboelectrically charged toner particles making part of a bunch of toner particles carried by a laminar air flow in a long narrow tube 1 at a mean speed $v_m$ while passing through an electrical field E maintained perpendicular to the axis of said tube 1 by a registration electrode plate 2 and plate electrode 3 of opposite charge sign with respect to the registration electrode. Said electrodes are forming a condensor with plate distance y (5 cm). A bunch of triboelectrically charged toner particles is injected by air-pulse into said tube 1 from a little pot 4 containing an air injection inlet 5 and a certain amount of electrostatographic powder developer to be tested. The developer is composed of magnetic carrier particles mixed with toner particles. The carrier particles are retained in the pot 4 by means of a magnetic field stemming from an electromagnet situated at the bottom of said pot.

In said test arrangement all toner particles with constant ratio q/d deposit in said tube according to their charge sign on the electrode of opposite charge sign as a "toner spectrum line at a point "x" in the tube, so that q/d=f (x).

The registered toner deposit at x=0 (obtained by deposition in the absence of laminar flow) is used for controlling the equipment and for easy analysis of the records obtained. At a plate distance of y=50 mm of said condensor for producing the electric field E the following equation may be used to determine the q/d value of toner particles deposited at different points "x".

$$q\,E=3\pi\eta\,v_m\,d\,y/x$$

where:

q is in fC, E is the electric field in kV/y, d is in 10 μm units, π is 3.14 . . . , η is the air viscosity, and x and y are in mm.

When the air flow AF is expressed in liter/min the q/d value is calculated by the following equation:

$$q/d(fC/10\ \mu m)=a\ 36\ AF(\text{ltr/min})/V(\text{kV})\times(\text{mm})$$

where:

V is the voltage between the electrodes, and "a" is a correction factor for small broadness of the registration electrode. By means of a photomicroscope (microscope coupled to CCD-video camera) operating with an image analyzer the quantity of deposited toner particles and the percentage of toner deposited at same place is determined.

For more detailed information how to operate said "q-meter" reference is made to its operation manual of March 1988.

In an invention-toner the resin or resin mixture present in the toner particles is of the type which will acquire a triboelectric charge which is dominantly negative. Such can be checked e.g. by rubbing it with iron carrier beads of 70 μm diameter and having an iron oxide skin predominantly composed of magnetite ($Fe_3O_4$). These carrier particles having an almost spherical shape are prepared by a process as described in GB-P 1,174,571.

Preferably used resins belong to the group of the higher negatively chargeable resins. Polytetrafluoroethylene is the most negatively chargeable triboelectric partner of the triboelectric series described in the already mentioned article "Physics of Electrophotography" in Physics Today p. 51).

Thermoplastic resins suited for use according to the present invention having negative triboelectric chargeability with respect to iron oxide such as magnetite ($Fe_3O4_3$) have a still higher negative chargeability with respect to "silicone elastomer with silica filler" which is the most positively chargeable species presented at the top of the already mentioned triboelectric series published in said journal "Physics Today". Therefore as triboelectric partner for relatively highest negative chargeability preferably substances, e.g. carrier particles, containing or coated with silicone resin are used.

Examples of resins showing high negative chargeability are of the class of resins, e.g. polyesters, in which free carboxylic acid and/or acid anhydride groups are present. Further are mentioned styrene-acrylic or methacrylic co- or terpolymers containing anionic groups, e.g. carboxylic acid groups or sulphonate groups, or electronegative groups such as anhydride groups, halide or nitrile groups or other negative charge inducing groups such as ether groups, sulphone groups, etc. When using resins containing acid or anhydride groups those resins having a total acid value of at least 1 mg KOH/g are preferred.

Particularly useful negatively chargeable resins are listed by No. in the following Table 1. Of these resins the glass transition temperature Tg in ° C. is given together with their number-average molecular weight (Mn) and weight-average molecular weight (Mw). The mentioned Mn and Mw values have to be multiplied by $10^3$. The resins containing free carboxylic acid groups and/or acid anhydride groups are characterized by their total acid value (AV) expressed mg KOH/g.

TABLE 1

| No. | Chemical structure | AV | Tg | Mn | Mw |
|---|---|---|---|---|---|
| 1 | Polyester resin of dimethyl-terephtalate, ethyleneglycol and Dianol 22 | 3 | 62 | 3.6 | 10 |
| 2 | Polyester resin made by polycondensation of fumaric acid and Dianol 33 | 17 | 53 | 4.4 | 12 |
| 3 | Polyester resin made by polycondensation of terephthalic acid, isophthalic acid and Dianol 22 and ethyleneglycol | 18 | 58 | 4.0 | 15 |
| 4 | Copoly(styrene-butylacrylate-butylmethacrylate-stearyl-methacrylate-methacrylic acid) (65/5/21/5/4) | 12 | 58 | 6 | 108 |
| 5 | Copoly(styrene-butylmethacrylate-acrylic acid) (80/15/5) | 5 | 63 | 5.5 | 180 |
| 6 | Copoly(styrene-butylacrylate-acrylonitrile) (75/20/5) | — | 61 | 12 | 143 |

Dianol 22 is ethoxylated 2,2-bis(4-hydroxyphenyl)propane. Dianol 33 is propoxylated 2,2-bis(4-hydroxyphenyl)propane.

By the high triboelectric negative charging capability of said resin(s) applied in toner particles prepared according to the present invention further negative charge controlling substances have not to be used. The presence of said resins provides already a strong negative net charge represented by a high q/d and wherein the q/d distribution in a bunch of the toner particles is very narrow and wrong sign (positive) toner particles are missing.

Figure 2:
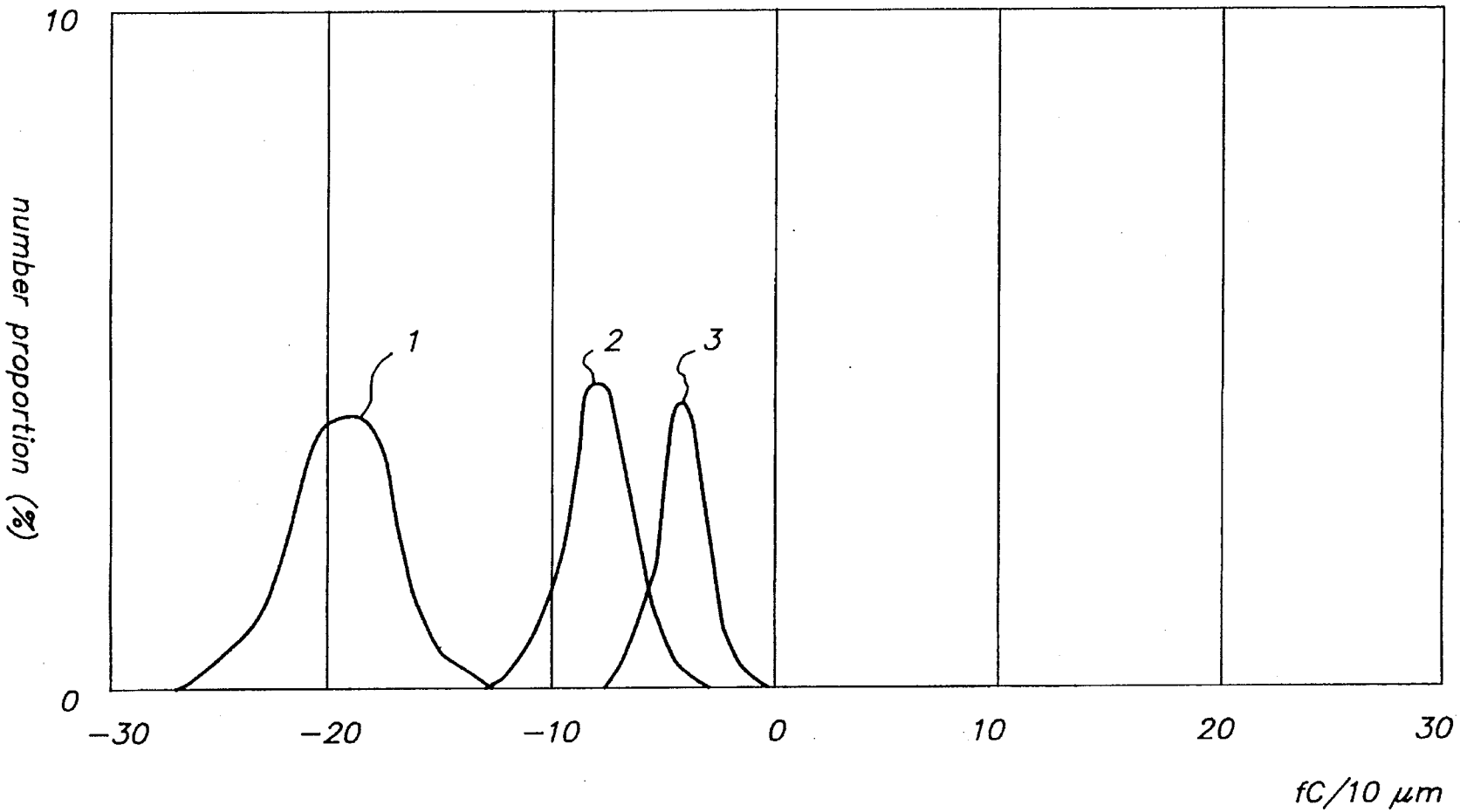
FIG. 2 represents a toner q/d distribution curve 1 of a comparative test toner (see Example 1, toner A) having in ordinate the number proportion % of toner particles of same q/d ratio value, the q/d ratio in fC/10μm being plotted in the abscissa. In said toner the toner particles are free from said resistivity decreasing substance (2). The toner is subjected to the test conditions applied in the apparatus operating along the principles described with respect to FIG. 1.

The influence of a strong negatively chargeable resin on the charge distribution and q/d of individual toner particles shown by the comparative (non-invention) Example 1 referring to curve 1 in FIG. 2. From said curve 1 can be derived that the coefficient of variation for a toner bulk of said toner particles is smaller than 0.33, which means that the charge over the toner particles is very homogeneously distributed but that the charge per particle is relatively high, viz. the q/d value is −19.1 fC/10 μm.

As explained hereinbefore with such kind of toner the optical density obtainable per unit area of charged recording material will be low in comparison with the density obtainable with a toner of same q/d distribution spectrum but of lower median value of q/d (expressed in fC/10 μm) of the toner particles.

Comparing in said FIG. 2 the q/d distribution curve 2 of an invention-toner with curve 1 of said non-invention toner we learn that said curve 2 having same shape as curve 1 is shifted to the left, i.e. fC/10 μm of the toner particles has dropped by the presence of said resistivity decreasing compound (2) in each of the toner particles, whereas there is no change in the coefficient of variation.

The equally lowered net charge per toner particle of said invention toner makes it possible to obtain therewith in electrostatic development a higher optical density per unit area than could be obtained in the absence of said resistivity lowering substance(s) (2).

As can be learned further from said curve 2 of FIG. 2 showing narrow q/d distribution no wrong charge sign (positive) toner particles and no too poorly charged toner particles are present so that electrostatic images developed therewith are free from image background fog.

The resistivity decreasing substance applied according to the present invention may be any ionic substance or electronically conductive substance that is preferably no charge controlling agent for positive charging in the toner particles and that is applied in an amount for bringing the toner particle charge under triboelectric charging conditions applied in electrostatographic development at an absolute median q/d value of at most 10 fC/10 μm without changing charge sign of the individual toner particles of the toner bulk.

It is assumed that the resistivity decreasing substance(s) form so-called conductive spots at the surface of the toner particles.

Resistivity decreasing substances suited for use according to the present invention are cationic, anionic or amphoteric type surfactants—see e.g. Tensid-Taschenbuch Herausgegeben yon Dr. Helmut Stache Carl Hanser Verlag München Wien 1979) or anti-static substances of non-ionic type e.g. non-ionic surfactants or electronically conductive substances.

Examples of such resistivity decreasing substances (2) are within the following classes of compounds:

- metal salts containing relatively large (bulky) anionic groups
- betaines
- amino acids
- metal complex compounds
- ionically conductive polymers in which the polymer chain carries anionic groups, e.g. sulphonate groups
- electronically conductive polymers, e.g. polyanilines, polypyrroles and polythiophenes.

However, within said cited classes not all compounds exhibit the required resistivity decrease. As mentioned above a concentration of 5% by weight in the selected binder composition has to decrease thereof the volume resistivity by a factor of at least 3.3.

The measuring procedure for selecting the resistivity decreasing substance proceeds by a test R described hereinafter.

TEST R

The resin or resin mixture to be tested is melt-blended with the resistivity decreasing substance being added in an amount of 5% by weight with respect to the resin mass. The melt-blending proceeds at 110° C. for 30 minutes using a laboratory melt-kneader Type W50H (sold by Brabender OGH Kulturstra E 51–55 D4100 Duisburg 1).

After melt-mixing the product is solidified and milled using a laboratory mill Type A10 (sold by Janke and Kunkel—Germany). The product is sieved over 63 μm mesh. The fraction passing through is collected and compressed with a pressure of 10 ton full load for 1 minute to form a circular tablet having a diameter of 13 mm and height of 1.15 mm.

The conductivity is measured after conditioning at 20° C. and 50 relative humidity for 24 h. The tablet is corona charged up to 1100 V and the conductivity is determined by taking the voltage after 10 minutes of charge decay and comparing it with the voltage at start. From said measurement the specific resistivity or volume resistivity $\rho_s$ in Ohm.cm is determined by the following equation:

$$\rho_s = t/3.3 \times 8.854 \times 10^{-14} \times 1n(Ua/Ub)$$

wherein:

$\rho_s$=volume resistivity (ohm-cm)

t=time of charge decay (t=10 minutes)

Ua=charging potential at t=0 minutes

Uba=charging potential at t=10 minutes

Preferred resistivity decreasing compounds decrease the resistivity already in a substantial degree by use in a fairly small concentration in the toner. The incorporation of large amounts of resistivity decreasing compounds in the toner mass is not desirable since said compounds may give rise to unwanted mechanical properties, e.g. provide a toner that is too soft.

Other particularly useful resistivity decreasing substances are non-ionic antistatic polyether type compounds, e.g. according to the following general formula:

$$R_1{=}[{-}O{=}(CH_2)_n{-}]_m{=}R_2$$

wherein:

each of $R_1$ and $R_2$ (same or different) represents hydrogen or an organic group, e.g. alkyl group, n is a positive integer of at least 20, and m is a positive integer of at least 2, preferably at least 100.

Polyether compounds such as polyethylene glycol having a molecular weight of at least 1000 up to 30,000 are preferred.

Other particularly useful resistivity decreasing substances are anionic compounds according to one of following general formulae:

| | | | |
|---|---|---|---|
| $(R{-}COO)^-$ | $M^{n+}$ | $(R{-}PO_3)^{2-}$ | $M^{2n+}$ |
| $(R{-}O{-}SO3)^-$ | $M^{n+}$ | $(R{-}PO_4)^{2-}$ | $M^{2n+}$ |
| $(R{-}S{-}SO_3)^-$ | $M^{n+}$ | $(RH{-}PO_4)^-$ | $M^{n+}$ |
| $(R{-}SO_3)^-$ | $M^{n+}$ | $(R_2{-}PO_4)^-$ | $M^{n+}$ |

wherein:

R is an organic group, e.g. is (1) an unsubstituted or substituted aliphatic, or cycloaliphatic group, e.g. substituted with halogen, aryl, alkoxy or thioether group, e.g. is a perfluoroalkyl group, including an aliphatic chain interrupted by one or more hetero atoms, e.g. nitrogen, oxygen or sulphur atom(s), and/or one or more of said hetero atoms being present in one or more substituents on said chain, (2) substituted or unsubstituted homocyclic aromatic group, including mono- and multi-aromatic ringsystems, (3) substituted or unsubstituted heterocyclic ring or ringsystem, $M^+$ is a cation, e.g. alkali metal cation, preferably $Li^+$, and n represents valency number 1 where necessary multiplied by a whole number to satisfy charge equivalency with the negative charge of the associated anionic group.

The toner particles prepared according to the present invention normally contain a colorant but may be colourless. A colourless toner may find application e.g. to create a glossy toner layer on an already existing visible toner image (ref. e.g. published EP-A 0 486 235).

For producing visible images the toner particles contain in the resinous binder a colorant which may be black or has a colour of the visible spectrum, not excluding however the presence of infra-red or ultra-violet absorbing substances and substances that produce black in admixture.

In the preparation of coloured toner particles a resinous mass as defined herein is mixed with colouring matter which may be dispersed in said blend or dissolved therein forming a solid solution.

In black-and-white copying the colorant is usually an inorganic pigment which is preferably carbon black, but is likewise e.g. black iron (III) oxide. Inorganic coloured pigments are e.g. copper (II) oxide and chromium (III) oxide powder, milori blue, ultramarine cobaltblue and barium permanganate.

Examples of carbon black are lamp black, channel black and furnace black e.g. SPEZIALSCHWARZ IV (trade name of Degussa Frankfurt/M—Germany) and VULCAN XC 72 and CABOT REGAL 400 (trade names of Cabot Corp. High Street 125, Boston, U.S.A.).

The characteristics of a preferred carbon black are listed in the following Table 2.

TABLE 2

| | |
|---|---|
| origin | furnace black |
| density | 1.8 g × $cm^{-3}$ |
| grain size before entering the toner | 25 nm |
| oil number (g of linseed oil adsorbed by 100 g of pigment | 70 |
| specific surface (sq.m per g) | 96 |
| volatile material (% by weight) | 2.5 |
| pH | 4.5 |
| colour | black |

In order to obtain toner particles having magnetic properties a magnetic or magnetizable material in finely divided state is added during the toner production.

Materials suitable for said use are e.g. magnetizable metals including iron, cobalt, nickel and various magnetizable oxides, e.g. heamatite ($Fe_2O_3$), magnetite ($Fe_3O_4$), $CrO_2$ and magnetic ferrites, e.g. these derived from zinc, cadmium, barium and manganese. Likewise may be used various magnetic alloys, e.g. permalloys and alloys of cobalt-phosphors, cobalt-nickel and the like or mixtures of these.

Toners for the production of colour images may contain organic dyes or pigments of the group of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York, U.S.A. (1950).

Likewise may be used the dyestuffs described in the following published European patent applications (EP-A) 0 384 040, 0 393 252, 0 400 706, 0 384 990, and 0 394 563.

Examples of particularly suited organic dyes are listed according to their colour yellow, magenta or cyan and are identified by name and Colour Index number (C.I. number) in the following Table 3 which also refers to the manufacturer.

TABLE 3

| | Colour Index 1 and 2 | | Manufacturer |
|---|---|---|---|
| Yellow dye | | | |
| Permanent Yellow GR | PY 13 | 21100 | Hoechst AG |
| Permanent Yellow GG02 | PY 17 | 21105 | id |
| Novoperm Yellow FGL | PY 97 | 11767 | id |
| Permanent Yellow GGR | PY 106 | | id |
| Permanent Yellow GRY80 | PY 174 | | id |
| Sicoechtgelb D1155 | PY 185 | | BASF |
| Sicoechtgelb D1350DD | PY 13 | 21100 | id |
| Sicoechtgelb D1351 | PY 13 | 21100 | id |
| Sicoechtgelb D1355DD | PY 13 | 21100 | id |
| Magenta dye | | | |
| Permanent Rubin LGB | PR57:1 | 15850:1 | Hoechst AG |
| Hostaperm Pink E | PR122 | 73915 | id |
| Permanent Rubin E02 | PR122 | 73915 | id |
| Permanent Carmijn FBB02 | PR146 | 12433 | id |
| Lithol Rubin D4560 | PR57:1 | 15850:1 | BASF |
| Lithol Rubin D4580 | PR57:1 | 15850:1 | id |

TABLE 3-continued

| | Colour Index 1 and 2 | | Manufacturer |
|---|---|---|---|
| Lithol Rubin D4650 | PR57:1 | 15850:1 | id |
| Fanal Rosa D4830 | PR81 | 45160:1 | id |
| Cyan dye | | | |
| Hostaperm Blue B26B | PB15:3 | 74160 1 | Hoechst AG |
| Heliogen Blau D7070DD | PB15:3 | 74160 | BASF |
| Heliogen Blau D7072DD | PB15:3 | 74160 | BASF |
| Heliogen Blau D7084DD | PB15:3 | 74160 | id |
| Heliogen Blau D7086DD | PB15:3 | 74160 | id |

In order to obtain toner particles with sufficient optical density in the spectral absorption region of the colorant, the colorant is preferably present therein in an amount of at least 1% by weight with respect to the total toner composition, more preferably in an amount of 1 to 10% by weight.

In order to improve the flowability of the toner particles spacing particles may be incorporated therein. Said spacing particles are embedded in the surface of the toner particles or protruding therefrom. These flow improving additives are preferably extremely finely divided inorganic or organic materials the primary (i.e. non-clustered) particle size of which is less than 50 nm. Widely used in this context are fumed inorganics of the metal oxide class, e.g. selected from the group consisting of silica ($SiO_2$), alumina ($Al_2O_3$), zirconium oxide and titanium dioxide or mixed oxides thereof which have a hydrophilic or hydrophobized surface.

Fumed metal oxides are prepared by high-temperature hydrolysis of the corresponding vaporizable chlorides according to the following reaction scheme illustrative for the preparation of fumed $Al_2O_3$:

$$4\ AlCl_3 + 6\ H_2 + 3\ O_2 \rightarrow 2\ Al_2O_3 + 12\ HCl$$

The fumed metal oxide particles have a smooth, substantially spherical surface and before being incorporated in the toner mass are preferably coated with a hydrophobic layer, e.g. formed by alkylation or by treatment with organic fluorine compounds. Their specific surface area is preferably in the range of 40 to 400 $m^2/g$.

In preferred embodiments fumed metal oxides such as silica ($SiO_2$) and alumina ($Al_2O_3$ ) are incorporated in the particle composition of the toner particles in an amount in the range of 0.1 to 10% by weight with respect to the toner particle mass.

Fumed silica particles are commercially available under the tradenames AEROSIL and CAB-O-Sil being trade names of Degussa, Franfurt/M Germany and Cabot Corp. Oxides Division, Boston, Mass., U.S.A. respectively. For example, AEROSIL R972 (tradename) is used which is a fumed hydrophobic silica having a specific surface area (BET-value) of 110 $m^2/g$. The specific surface area can be measured by a method described by Nelsen and Eggertsen in "Determination of Surface Area Adsorption measurements by continuous Flow Method", Analytical Chemistry, Vol. 30, No. 9 (1958) p. 1387–1390.

In addition to the fumed metal oxide, a metal soap e.g. zinc stearate may be present in the toner particle composition.

Instead of dispersing or dissolving (a) flow-improving additive(s) in the resin mass of the toner particle composition they may be mixed with the toner particles, i.e. are used in admixture with the bulk of toner particles. For that purpose zinc stearate has been described in the United Kingdom Patent Specification No. 1,379,252, wherein also reference is made to the use of fluor-containing polymer particles of sub-micron size as flow improving agents. Silica particles that have been made hydrophobic by treatment with organic fluorine compounds for use in combination with toner particles are described in published EP-A 467439.

The toner composition of the present invention can be prepared by a number of known methods. For example, by melt blending of the toner ingredients, cooling the melt down to a solid mass that is crushed and finely divided, followed by a classification step providing the desired particle size selection. In melt blending preferably a kneader is used. The kneaded mass has preferably a temperature in the range of 90° to 140° C., and more preferably in the range of 105° to 120° C. After cooling the solidified mass is crushed, e.g. in a hammer mill and the obtained coarse particles further broken e.g. by a jet mill to obtain sufficiently small particles from which a desired fraction can be separated by sieving, wind sifting, cyclone separation or other classifying technique. The actually used toner particles have preferably an average diameter between 3 and 20 μm determined versus their average volume, more preferably between 5 and 10 μm when measured with a COULTER COUNTER (registered trade mark) Model TA II particle size analyzer operating according to the principles of electrolyt displacement in narrow aperture and marketed by COULTER ELECTRONICS Corp. Northwell Drive, Luton, Bedfordshire, LC 33, UK.

Suitable milling and air classification may be obtained when employing a combination apparatus such as the Alpine Fliessbeth-Gegenstrahlmühle (A.G.F.) type 100 as milling means and the Alpine Turboplex Windsichter (A.T.P.) type 50 G.S as air classification means, available from Alpine Process Technology, Ltd., Rivington Road, Whitehouse, Industrial Estate, Runcorn, Cheshire, UK. Another useful apparatus for said purpose is the Alpine Multiplex Zick-Zack Sichter also available from the last mentioned company.

Other methods for preparing toner particles of a composition according to the present are e.g. spray drying, dispersion polymerization and suspension polymerization. In one dispersion polymerization method, a solvent dispersion of the resin particles, the colorant pigment particles, and the additives such as said resistivity lowering substance(s) (2) are spray dried under controlled conditions to result in the desired product.

To the obtained toner mass a flow improving agent may be added with high speed stirrer, e.g. HENSCHEL FM4 of Thyssen Henschel, 3500 Kassel Germany.

As explained already above the surface of the triboelectric partner used in conjunction with the toner particles and the kind of resin(s) contained in the toner particles determines the net charge sign acquired by the toner particles. The carrier particles for use in a developer composition according to the present invention have to offer in triboelectric charging a negative charge to the toner particles.

Suitable carrier particles for use in cascade or magnetic brush development are described e.g. in United Kingdom Patent Specification 1,438,110. For magnetic brush development the carrier particles may be on the basis of ferromagnetic material e.g. steel, nickel, iron beads, ferrites and the like or mixtures thereof. The ferromagnetic particles may be coated with a resinous envelope or are present in a resin binder mass as described e.g. in U.S. Pat. No. 4,600,675. The average particle size of the carrier particles is preferably in the range of 20 to 300 μm and more preferably in the range of 50 to 300 μm . The carrier particles possess sufficient density and inertia to avoid adherence to the electrostatic charge images during the development process. The carrier particles can be mixed with the toner particles in various ratios, best results being obtained when about 1 part by weight of toner is mixed with about 10 to 200 parts of carrier. The shape of the carrier particles, their surface coating and their density determines their flow properties. Easily flowing carrier particles with spherical shape can be prepared according to a process described in United Kingdom Patent Specification 1,174,571.

The toner particles prepared according to the present invention may be fixed to their final substrate with known heat-fixing or heat-and-pressure fixing means. For obtaining optimal fixing results, e.g. by radiant heat, their melt viscosity may be controlled by the kind of resin binder and material dispersed or dissolved therein such as one or more of the above identified flowing agents that are added as fillers.

The following examples illustrate the present invention without however limiting it thereto. Parts, ratios and percentages are by weight unless otherwise indicated.

EXAMPLE 1

Preparation of Non-Invention Comparison Toner A 97 parts of polymer No. 1 of Table 1 having an acid value of 3 and volume resistivity of $2\times10^{16}$ ohm-cm was melt-blended for 30 minutes at 110° C. in a laboratory kneader with 3 parts of Cu-phthalocyanine pigment (Colour Index PB 15:3).

After cooling the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner measured by Coulter Counter model Multisizer (tradename) was found to be 6.3 μm average by number and 8.2 μm average by volume. In order to improve the flowability of the toner mass the toner particles were mixed with 0.5% of hydrophobic colloidal silica particles (BET-value 130 $m^2/g$).

An electrostatographic developer was prepared by mixing said mixture of toner particles and colloidal silica in a 4% ratio with spherical iron carrier particles having an oxide skin and particle size in the range of 50 to 150 μm.

The triboelectric charging of the toner-carrier mixture was carried out in the X-35 (tradename of Agfa-Gevaert N.V.) electrophotographic copier and operated for development in the reversal mode. From the unit containing the triboelectrically charged developer a sample was extracted for charge measurement with the above identified "q-meter".

A median q/d value of −19.1 fC/10 μm with a coefficient of variation of 0.14 was found. The resultant q/d distribution is shown in curve 1 of FIG. 2.

Using a graphic art original in the exposure the toner development with said non-invention comparison toner A in said X-35 apparatus yielded a blue image having a maximum optical density of only 0.95. The copy was free from background fog.

Preparation of Invention Toner B

The preparation of toner A was repeated with the difference however, that to the toner composition in the melt-blending step as resistivity decreasing substance 0.5 parts of an anionic surfactant having the following formula:

$(CF_3)—(CF_2)_7—SO_3Li$ was added.

By the test R described above it was found that the volume resistivity of the applied binder resin by mixing therewith 5% of said surfactant was lowered to $4.4\times10^{14}$ ohm-cm which proves a high resistivity decreasing capacity (reduction factor: 45).

From the triboelectrically charged toner-carrier mixture as described for toner A a sample was extracted for charge measurement with the above identified "q-meter".

A median q/d value of −8.3 fC/10 μm with a coefficient of variation of 0.16 was found. The resultant q/d distribution is shown in curve 2 of FIG. 2.

Using a graphic art original in the exposure the toner development with the invention toner B in said X-35 apparatus yielded a blue image having a maximum optical density of 1.5. The copy was free from background fog.

Preparation of Invention Toner C

The preparation of invention toner B was repeated with the difference however, that in the toner composition in the melt-blending step the concentration of the resistivity decreasing substance was increased to 0.75% with respect to the resinous binder.

From the triboelectrically charged toner-carrier mixture as described hereinbefore a sample was extracted for charge measurement with the above identified "q-meter". A median q/d value of −4.5 fC/10μm with a coefficient of variation of 0.20 was found. The resultant q/d distribution is shown in curve 3 of FIG. 2.

Using a graphic art original in the exposure the toner development with the invention toner B in said X-35 apparatus yielded a blue image having a maximum optical density of 1.8. The copy was free from background fog.

EXAMPLE 2 (COMPARATIVE EXAMPLE)

In a series of test compositions as resinous binder for the toner styrene-butylmethacrylate-acrylic acid copolymer No. 5 of Table 1 with negative charging capacity and acid value 5 was partially replaced by increasing amounts of a practically zero charging copolymer No. 7 having same composition as said copolymer No. 5 but being free from acrylic acid units.

The resinous binder mixtures (see Table 4 hereinafter) were melt-blended with a colorant as described in Example 1.

The thus prepared toners were triboelectrically charged with a silicon coated CuZn ferrite carrier of 25–75 μm size being selected for the reason that copolymer No. 7 showed practically no triboelectric charging with said carrier.

Figure 3:
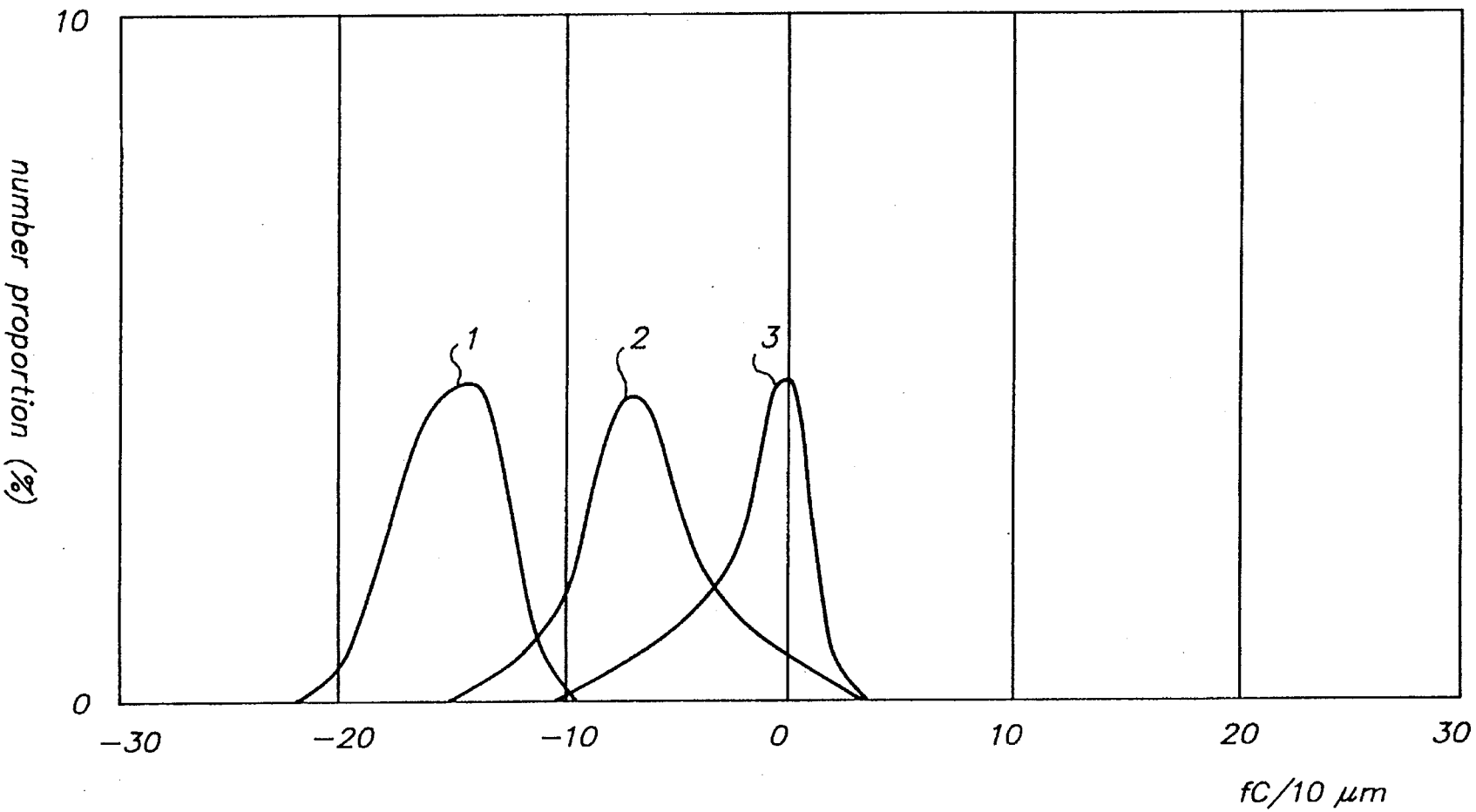
FIG. 3 represents a series of toner q/d distribution curves showing the shift of the q/d distribution curve by using a blend of resins one of which has a relatively high negative charging capacity by its intrinsic constitution and acid number stemming from the presence of free carboxylic acid groups and the other is neutral (see Comparative Example 2).

From said toners related q/d distribution curves 1 to 3 in FIG. 3 can be learned that by the use in the toner composition of said "non-charging" copolymer resin No. 7 the broadness of the q/d distribution curves increases rapidly and that a considerable fraction of low-charged toner particles is obtained.

Copies made with the above prepared toners in the already mentioned X-35 electrophotographic copier show that an optical density larger than 1 is only obtained when the median q/d value of the toner particles is lower than 10 fC/10 μm, but that at the same time the coefficient of variation (v) of such low-charge toners may not be higher than 0.33 for otherwise an unacceptable background fog is formed.

TABLE 4

| | % wt. of copolymers | | median q/d | | |
|---|---|---|---|---|---|
| Example 2 | No. 5 | No. 7 | curve | fc/10 μm | v |
| a | 100 | 0 | 1 | −15 | 0.18 |
| b | 75 | 25 | — | −10 | 0.28 |
| c | 50 | 50 | 2 | −7 | 0.38 |
| d | 25 | 75 | 3 | −2.5 | 0.91 |
| e | 0 | 100 | — | −2 | 0.68 |

EXAMPLE 3 (INVENTION EXAMPLE)

The preparation of the invention toner B of Example 1 was repeated with the difference however, that in the toner composition as resistivity decreasing substance a polyoxyethylene having an average molecular weight of 20,000 was used in an amount of 5% with respect to the binder.

By the test R described above it was found that the volume resistivity of the applied binder resin by mixing therewith 5% of said surfactant was lowered by a factor 3.6.

From the triboelectrically charged toner-carrier mixture as in Example 1 a sample was extracted for charge measurement with the above identified "q-meter". A median q/d value of −9 fC/10 μm with a coefficient of variation of 0.15 was found.

With the thus prepared toner developer prints with sufficient optical density without background fog were prepared.

EXAMPLE 4 (INVENTION EXAMPLE)

The Example 4 toner derives from a combination of elements of Examples 1 and 3 in that to the toner composition in the melt-blending step not only the anionic resistivity decreasing substance of Example 1C was used in a concentration of 0.75%, but also 0.5% of the polyoxyethylene of Example 3.

Hereby the conductivity of the toner was raised considerably, probably by the metal complex formation with the $Li^+$.

From the triboelectrically charged toner-carrier mixture as in Example 1 a sample was extracted for charge measurement with the above identified "q-meter". A median q/d value of −3.3 fC/10 μm with a coefficient of variation of 0.24 was found.

With the thus prepared toner developer prints with optical density 2.1 without background fog were prepared.

We claim:

1. A dry toner powder the toner particles of which are triboelectrically negatively charged and are suited for development of an electrostatic charge pattern, wherein said toner particles contain:

(1) one or more triboelectrically negatively chargeable thermoplastic resins serving as binder having a volume resistivity of at least $10^{13}\Omega$-cm, and (2) at least one substance having a volume resistivity lower than the volume resistivity of said binder, and wherein said substance(s) (2) is (are) capable of lowering the volume resistivity of said binder by a factor of at least 3.3 when present in said binder in a concentration of 5% by weight relative to the weight of said binder, and wherein said toner powder containing particles including a mixture of said ingredients (1) and (2) under triboelectric charging conditions is capable of obtaining an absolute median (q/d) charge/diameter value (x) lower than 10 fC/10

μm but not lower than 1 fC/10 μm, and said toner powder under the same triboelectric charging conditions but free from said substance(s) (2) then has an absolute median q/d value (x) at least 50% higher than when said substance(s) (2) is (are) present, and wherein the distribution of the charge/diameter values of the individual toner particles is characterized by a coefficient of variation $v \leqq 0.33$.

2. Dry toner particles according to claim 1, wherein said toner particles are free from charge-controlling agent for positive charging.

3. Dry toner powder according to claim 1, wherein said resin(s) have a volume resistivity of at least $10^{15}\Omega$-cm.

4. Dry toner powder according to claim 1, wherein said toner particles contain as binder a polyester resin.

5. Dry toner powder according to claim 4, wherein said polyester contains free carboxylic acid and/or acid anhydride groups.

6. Dry toner powder according to claim 1, said toner particles contain as binder (a) styrene-acrylic or methacrylic co- or terpolymer(s) containing carboxylic acid or sulphonate groups or electronegative groups selected from the group consisting of anhydride, halide, nitrile, sulphone and ether groups.

7. Dry toner powder according to claim 1, wherein said negatively chargeable thermoplastic resin(s) have a total acid value of at least 1 mg KOH/g.

8. Dry toner powder according to claim 1, wherein said resistivity decreasing substance(s) is (are) any ionic substance or electronically conductive substance that is no charge controlling agent for positive charging in the toner particles and that is (are) applied in an amount for bringing the toner particle charge under triboelectric charging conditions applied in electrostatographic development at an absolute median q/d value of at most 10 fC/10 μm without changing charge sign of the individual toner particles of the toner bulk.

9. Dry toner powder according to claim 1, wherein said resistivity decreasing substances (2) are anionic, amphoteric or non-ionic type surfactants or electronically conductive substances.

10. Dry toner powder according to claim 1, wherein said resistivity decreasing substances (2) are substances within the following classes of compounds:

metal salts containing relatively large (bulky) anionic groups betaines amino acids metal complex compounds ionically conductive polymers in which the polymer chain carries anionic groups, electronically conductive polymers.

11. Dry toner powder according to claim 1, wherein said resistivity decreasing substances (2) are non-ionic antistatic polyether type compounds according to the following general formula:

$$R_1{=}[{-}O{=}(CH_2)_n{-}]_m{=}R_2$$

wherein:

each of $R_1$ and $R_2$ (same or different) represents hydrogen or an organic group, e.g. alkyl group, n is a positive integer of at least 20, and m is a positive integer of at least 2.

12. Dry toner powder according to claim 1, wherein said resistivity decreasing substances (2) are anionic compounds according to one of following general formulae:

| | | | |
|---|---|---|---|
| $(R{-}COO)^-$ | $M^{n+}$ | $(R{-}PO_3)^{2-}$ | $M^{2n+}$ |
| $(R{-}O{-}SO3)^-$ | $M^{n+}$ | $(R{-}PO_4)^{2-}$ | $M^{2n+}$ |
| $(R{-}S{-}SO_3)^-$ | $M^{n+}$ | $(RH{-}PO_4)^-$ | $M^{n+}$ |
| $(R{-}SO_3)^-$ | $M^{n+}$ | $(R_2{-}PO_4)^-$ | $M^{n+}$ |

wherein:

R is an organic group, $M^+$ is a cation, and n represents valency number 1 where necessary multiplied by a whole number to satisfy charge equivalency with the negative charge of the associated anionic group.

13. Dry toner powder according to claim 11, wherein R is a perfluoroalkyl group, and $M^+$ is $Li^+$.

14. Dry toner powder according to claim 1, wherein said resistivity decreasing substance(s) (2) is (are) capable of decreasing said volume resistivity of the binder by a factor of at least 10 when present therein in a concentration of 5% by weight relative to the binder mass.

15. Dry toner powder according to claim 1, wherein said toner particles are colourless.

16. Dry toner power according to claim 1, wherein said toner particles are coloured.

17. Dry toner powder according to claim 1, wherein said toner particles are mixed with carrier particles giving them by triboelectric charging a negative charge.

* * * * *

UNITED STATES PATENT AND TRADEMARK OFFICE

CERTIFICATE OF CORRECTION

PATENT NO. : 5,569,567

DATED : October 29 1996

INVENTOR(S) : Serge Tavernier et al

It is certified that error appears in the above-indentified patent and that said Letters Patent is hereby corrected as shown below:

Column 5, line 32, "of at least $10^{-}\Omega$-cm," should read -- of at least $10^{13}\Omega$-cm, --;

Column 9, line 10, "ben yon Dr. Helmut" should read -- ben von Dr. Helmut --;

Column 9, line 52, "and 50 relative humidity" should read -- and 50% relative humidity --;

Column 10, approximately line 13, general formula "$R_1$=[-O=$(CH_2)_n$-]$_m$=$R_2$" should read -- $R_1$-[-O-$(CH_2)_n$-]$_m$-$R_2$ --;

Claim 11, column 18, line 10, general formula "$R_1$=[-O=$(CH_2)_n$-]$_m$=$R_2$" should read -- $R_1$-[-O-$(CH_2)_n$-]$_m$-$R_2$ --.

Signed and Sealed this

First Day of April, 1997

Bruce Lehman

*Attest:*

BRUCE LEHMAN

*Attesting Officer*

*Commissioner of Patents and Trademarks*